US008317188B1

(12) United States Patent
Lin et al.

(10) Patent No.: US 8,317,188 B1
(45) Date of Patent: Nov. 27, 2012

(54) MODULAR PRINT SYSTEM

(75) Inventors: Horng Jaan Lin, Lawrenceville, GA (US); Dale R. Lyons, Suwanee, GA (US)

(73) Assignee: NCR Corporation, Duluth, GA (US)

( * ) Notice: Subject to any disclaimer, the term of this patent is extended or adjusted under 35 U.S.C. 154(b) by 2414 days.

(21) Appl. No.: 10/873,928

(22) Filed: Jun. 22, 2004

(51) Int. Cl.
*B65H 1/00* (2006.01)

(52) U.S. Cl. ..... 271/162; 271/145

(58) Field of Classification Search ..... 271/145, 271/177–181, 162; 221/197, 287; 347/104; 399/377, 393
See application file for complete search history.

(56) References Cited

U.S. PATENT DOCUMENTS 4,189,139 A * 2/1980 Uchida et al. ..... 271/162
4,235,433 A * 11/1980 Hirata ..... 271/162
4,655,368 A * 4/1987 Bateman et al. ..... 221/4
4,854,247 A * 8/1989 Sciortino et al. ..... 109/1 R
5,105,364 A * 4/1992 Kawamura et al. ..... 700/219
5,615,625 A * 4/1997 Cassidy et al. ..... 109/45
5,647,507 A * 7/1997 Kasper ..... 221/151
5,829,898 A * 11/1998 Hill et al. ..... 400/624
5,871,209 A * 2/1999 Orchard et al. ..... 271/149
6,293,469 B1 * 9/2001 Masson et al. ..... 235/476
7,000,832 B2 * 2/2006 Washington et al. ..... 235/380
7,121,461 B2 * 10/2006 Washington et al. ..... 235/379
2001/0008253 A1 * 7/2001 Holec et al. ..... 235/381
2004/0016034 A1 * 1/2004 Calder et al. ..... 902/13
2004/0178564 A1 * 9/2004 Graef et al. ..... 271/162
2004/0188920 A1 * 9/2004 Washington et al. ..... 271/145
2004/0205024 A1 * 10/2004 Washington et al. ..... 705/43

* cited by examiner

*Primary Examiner* — Michael McCullough
(74) *Attorney, Agent, or Firm* — Paul W. Martin; Paul J. Maginot

(57) ABSTRACT

A modular print system which includes media cartridges instead of manually loaded feed trays. The print system includes a print module including a keyed entrance, and sealed cartridge containing media and including a keyed exit corresponding to the keyed entrance. The cartridge is removably attached to the print module.

20 Claims, 3 Drawing Sheets

MODULAR PRINT SYSTEM

BACKGROUND OF THE INVENTION

The present invention relates to printers and more specifically to a modular print system.

Printers include feed trays. Users must load the feed trays with media. Printers may not include feed trays for all types of media. Also, manually loaded feed trays offer no security to high-risk media, such as tickets, money order, and checks.

Therefore, it would be desirable to provide a modular print system in which provides an alternative to manually-loaded feed trays.

SUMMARY OF THE INVENTION

In accordance with the teachings of the present invention, a modular print system is provided.

The print system includes a print module including a keyed entrance, and sealed cartridge containing media and including a keyed exit corresponding to the keyed entrance. The cartridge is removably attached to the print module.

It is accordingly an object of the present invention to provide a modular print system.

It is another object of the present invention to provide a modular print system in which provides an alternative to manually-loaded feed trays.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
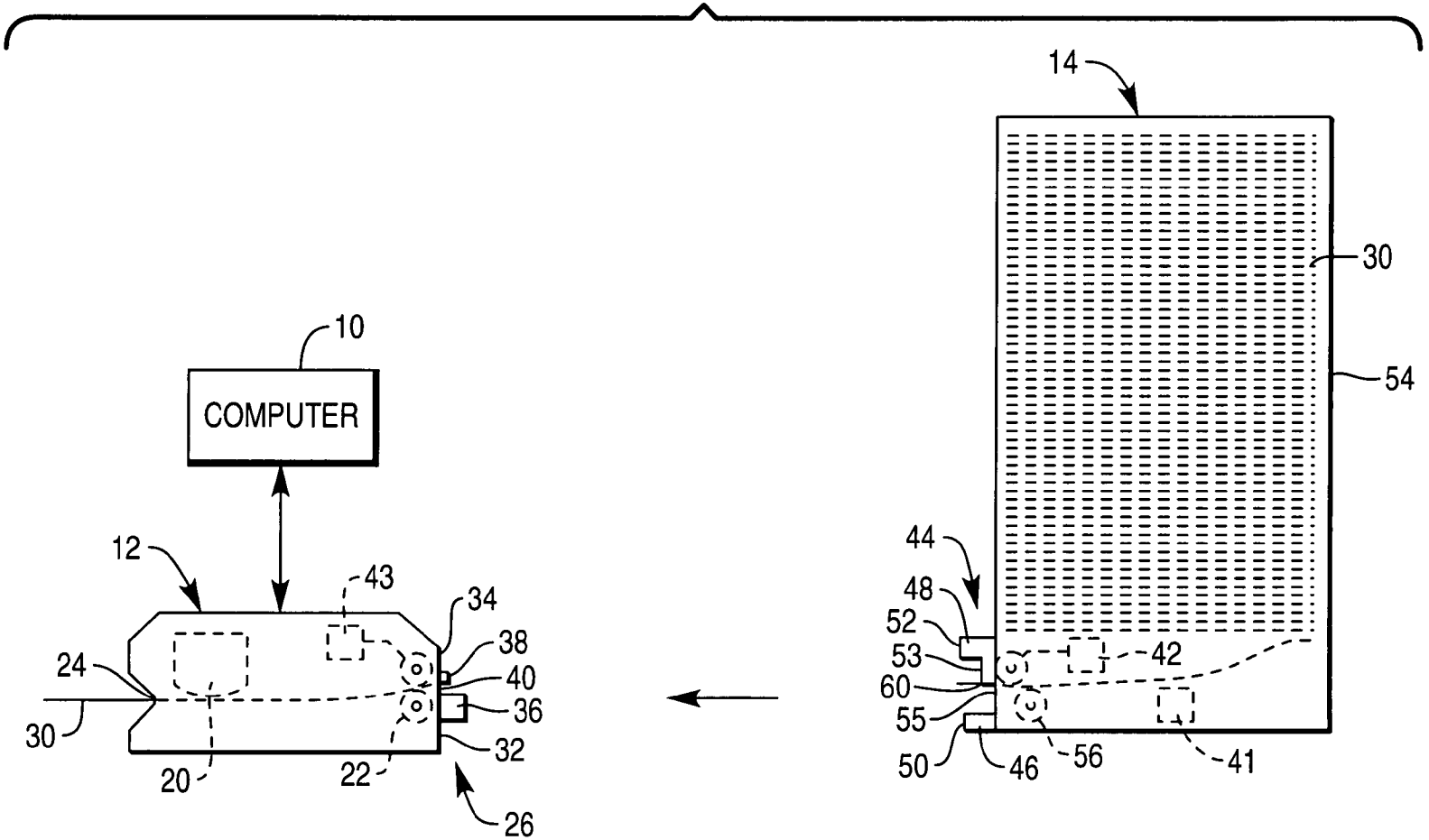
FIG. 1 is a side view of the modular printing system.

Referring now to FIG. 1, modular printing system 10 includes print head assembly 12 and media cartridge 14.

Print head module 12 includes print head 20 and media feed system 22.

Print head 20 applies ink to media 30.

Media feed system 22 transports media 30 from media cartridge 14, through media aperture 40, across print head 20, and out exit aperture 24.

Print head module 12 additionally includes keyed media entrance 26 which includes first key aperture 32, second key aperture 34, first key protrusion 36, and second key protrusion 38.

Media cartridge 14 includes media 30, housing 54, and media feed system 56.

Media 30 may include standard paper, such as 8½" by 11" paper. Media 30 may alternatively include high risk media, such as tickets, money order, and checks.

Housing 54 is sealed making housing 54 non-refillable. Housing 54 may include a dye pack or electric alarm circuit 41 around the inside periphery, which when activated, indicate a breach of housing 54.

Media feed system 56 directs media 30 from housing 54, through media aperture 60 to print head module 12.

Media cartridge 14 further includes keyed media exit 44, which has a shape that facilitates coupling to keyed media entrance 26 of print head module 12. First keyed protrusion 46 includes surface 50, which has similar dimensions to first key aperture 32. Second keyed protrusion 48 includes surface 52, which has similar dimensions to second key aperture 34.

Dimensions of first key aperture 32, second key aperture 34, first key protrusion 36, and second key protrusion 38 are arbitrary, but only a media cartridge 14 with a corresponding keyed media exit 44 can couple to print head module 12.

Certain media, such as tickets, may require security to control their usage. For this purpose, media cartridge 14 may include an electronic lock 42 that may only be unlocked through unlock circuitry 43 by an authorized user of media 30 and computer 10. For this purpose, keyed media exit 44 may electrically couple to keyed media entrance 26. The password to be entered at computer 10 may be encrypted, such as by public key encryption with a public key registered to the user.

Figure 2:
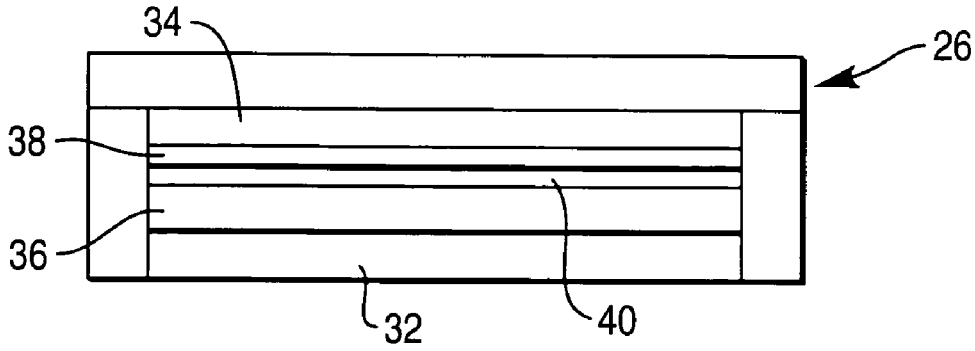
FIG. 2 is a view of a keyed media entrance of a print head module.

With reference to FIG. 2, keyed media entrance 26 of print head module 12 is illustrated in detail. The width of media entrance aperture 40 corresponds to the width of media 30.

Figure 3:
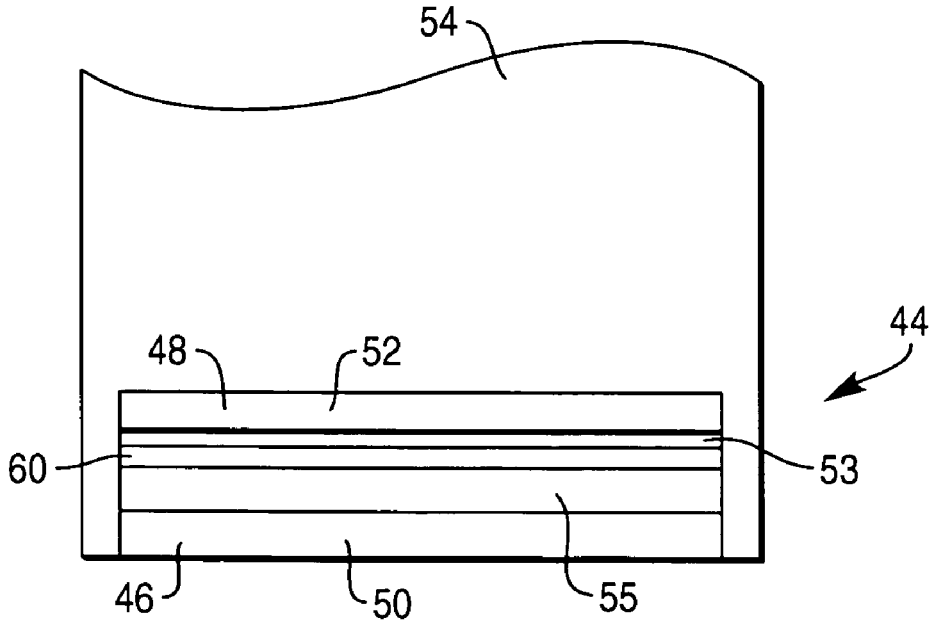
FIG. 3 is a view of a keyed media exit of a media cartridge.

With reference to FIG. 3, keyed media exit 44 of media cartridge 14 is illustrated in detail.

When engaged, keyed media entrance 26 of print head module 12 and keyed media exit 44 of media cartridge 14 are held together by friction.

First keyed protrusion 46 penetrates first keyed aperture 32 and second keyed protrusion 48 penetrates second keyed aperture 34. First keyed protrusion 36 abuts first keyed protrusion 46 and surface 55. Second keyed protrusion 38 abuts second keyed protrusion 48 and surface 53.

Figure 4:
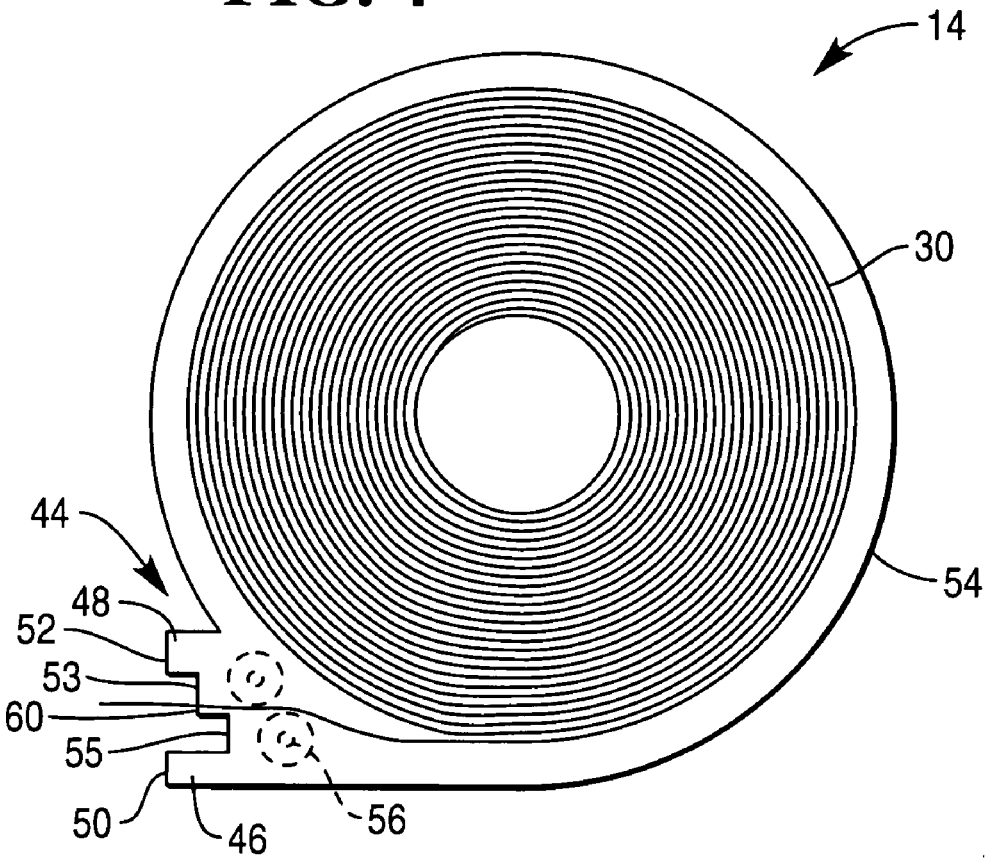
FIG. 4 is a side view of an alternate media cartridge.

With reference to FIG. 4, an alternate media cartridge 14 is shown. This media cartridge 14 shares the same keyed media exit 44 as the media cartridge of FIG. 1 and is suited for delivering a single stream of media 30, such as tickets. Individual tickets may be separated at cut or perforation lines after exiting through aperture 24 of print head module 12.

Although the invention has been described with particular reference to certain preferred embodiments thereof, variations and modifications of the present invention can be effected within the spirit and scope of the following claims.

What is claimed is:

1. A print system comprising:

a print module including a keyed entrance; and a sealed cartridge containing media and including a keyed exit corresponding to the keyed entrance, said print module for printing an image on the media stored in said sealed cartridge;

wherein the cartridge is removably attached to the print module.

2. The print system of claim 1, wherein the print module comprises:

a print head; and a media feed system.

3. The print system of claim 2, wherein the media feed system transports the media across the print head.

4. The print system of claim 1, wherein the cartridge comprises:

a sealed housing; and a media feed system.

5. The print system of claim 1, wherein the media comprises 8½" by 11" paper.

6. The print system of claim 1, wherein the media comprises money orders.

7. The print system of claim 1, wherein the media comprises tickets.

8. The print system of claim 1, wherein the cartridge is non-refillable.

9. The print system of claim 1, wherein the cartridge is disposable.

10. The print system of claim 1, wherein the cartridge comprises an electronic lock, which when in the unlocked position, allows the print module to draw the media from the cartridge.

11. A print system comprising:

a print module including a keyed entrance, a print head, and a first media feed system for transporting the media across the print head; and a sealed cartridge containing media and including a keyed exit corresponding to the keyed entrance, said print module for printing an image on the media stored in said sealed cartridge, a sealed housing, and a second media feed system for transporting the media from the cartridge; and wherein the cartridge is removably attached to the print module.

12. The print system of claim 11, wherein the media comprises secure media.

13. The print system of claim 11, wherein the housing is non-refillable.

14. The print system of claim 11, wherein the cartridge is disposable.

15. The print system of claim 11, wherein the cartridge comprises an electronic lock, which when in the unlocked position, allows the print module to draw the media from the cartridge.

16. A print system comprising:

a print module including a keyed entrance; and a sealed cartridge containing media and including a keyed exit corresponding to the keyed entrance;

wherein the cartridge is removably attached to the print module, said print module for printing an image on the media stored in said sealed cartridge, the media drawn from the cartridge when the cartridge is attached to the print module.

17. The print system of claim 16, wherein the print module comprises a:

a print head; and a media feed system.

18. The print system of claim 17:

Wherein the keyed entrance of said print module includes a plurality of protrusions and apertures; and Wherein the keyed exit of said sealed cartridge includes a plurality of protrusions and apertures, the apertures matingly receiving the protrusions.

19. The print system of claim 16, wherein the cartridge comprises:

a sealed housing; and a media feed system.

20. The print system of claim 16:

Wherein the keyed entrance of said print module includes one of a protrusion and a wall defining a aperture; and Wherein the keyed exit of said sealed cartridge includes the other of a protrusion and a wall defining an aperture, the aperture matingly receiving the protrusion.

* * * * *